United States Patent [19]

Slack

[11] Patent Number: 4,773,191

[45] Date of Patent: Sep. 27, 1988

[54] LIGHT AND CLIMATE CONTROL SYSTEM FOR PRE-STRESSED FABRIC STRUCTURES

[75] Inventor: James K. Slack, Calgary, Canada

[73] Assignee: Sprung Instant Structures Ltd., Alberta, Canada

[21] Appl. No.: 5,474

[22] Filed: Jan. 20, 1987

[51] Int. Cl.[4] ..... E04B 1/347; A45F 1/16

[52] U.S. Cl. ..... 52/63; 135/102; 52/222

[58] Field of Search ..... 52/63, 86, 222, 242; 135/102; 126/426; 47/17

[56] References Cited

U.S. PATENT DOCUMENTS

| | | | |
|---|---|---|---|
| 3,148,662 | 9/1964 | Morrell | 52/2 G |
| 3,353,309 | 11/1967 | Kwake | 52/2 D |
| 4,273,099 | 6/1981 | Morgan | 126/426 |
| 4,404,980 | 9/1983 | Wade | 135/102 |

*Primary Examiner*—James L. Ridgill, Jr.
*Attorney, Agent, or Firm*—Kenyon & Kenyon

[57] ABSTRACT

The present invention relates to a light and climate control system for pre-stressed fabric structures of the type having a plurality of arches and fabric under tension extending between adjacent to enclose a space. The fabric between the arches is composed of zones of exteriorly reflective opaque material and translucent material. The respective areas of the zones of these two materials are determined such that the zone of translucent material is of sufficient area to permit enough light to pass to the enclosed space during daylight, for adequate interior lighting of the enclosed space. The zone of reflective opaque material is of sufficient area to reduce solar radiation into the enclosed space to a degree which permits the air conditioner means to comfortably cool the interior.

9 Claims, 2 Drawing Sheets

LIGHT AND CLIMATE CONTROL SYSTEM FOR PRE-STRESSED FABRIC STRUCTURES

BACKGROUND OF THE INVENTION

Increasingly tent-like structures having a plurality of arches between which fabric under tension extends to enclose a space are becoming accepted construction forms for applications requiring large enclosed spaces, such as, for example, arenas, sport stadiums, storage terminals and the like. Such pre-stressed fabric structures, for example, are described and illustrated in Sprung U.S. Pat. Nos. 3,780,477 and 4,137,687. When such pre-stressed fabric structures have been used for certain applications, e.g. for trade shows, it has been observed that a translucent fabric provides a diffused natural light within the structure which is very appealing. No other artificial lighting is normally required during daylight hours. This has resulted however, particularly in warmer climates, in a significant heat build up which cannot be moderated to comfortable conditions by traditional climate control means such as air conditioners. On the other hand, when the fabric of the structure is made of opaque, reflective material, the space inside must then be illuminated using artificial light. This has proven unsatisfactory. For example in trade shows, exhibitors prefer the diffused, natural light provided by translucent fabrics during daylight hours for illumination of their exhibits.

Wade U.S. Pat. No. 4,404,980 issued Sept. 20, 1983 describes and illustrates a covered fabric structure in which transparent panels serving as windows and skylights are provided in the fabric, the windows and skylights having traditional functions of lighting and providing visibility through the fabric.

It is an object of the present invention to provide a climate and light-controlled pre-stressed fabric structure of the type in question, which is suitable for applications such as trade shows. It is a further object of the present invention to provide such a structure in which, during daylight hours, light and temperature within the structure are controlled by the fabric, the temperature control being in conjunction with air conditioner means cooling the interior of the structure.

SUMMARY OF THE INVENTION

In accordance with the present invention there is provided, for a pre-stressed fabric structure having a plurality of arches with fabric under tension extending between adjacent arches to enclose a predetermined space, and an air conditioner means to cool the enclosed space, a climate and light controlling means wherein the fabric between the arches is composed of zones of exteriorly reflective opaque material and translucent material. The size of the respective areas of the zones of these materials are determined such that the zone of translucent material is of sufficient area to permit enough light to pass to the enclosed space during daylight, for adequate interior lighting of the enclosed space. The zone of reflective opaque material is of sufficient area to reduce solar radiation in the enclosed space to a degree which permits the air conditioner means to comfortably cool the interior. In a preferred embodiment, particularly intended for warm weather conditions, the ratio of the surface area of the translucent material to that of the opaque material is 1:6.6. It is also preferred that the translucent material extend between the tops of the arches with the opaque material extending between the arches on either side of the translucent material.

The structure according to the present invention avoids many of the problems of temperature control experienced by prior art structures of the type in question. Artificial lighting, for example, in the interior is required only after dark. During the daytime, sufficient light is passed into the interior of the structure for lighting purposes while, at the same time, the usage of reflective opaque material prevents heat build up in the interior of the structure so that the air conditioning means has an opportunity to comfortably cool the interior.

BRIEF DESCRIPTION OF THE DRAWINGS

These and other objects and advantages of the invention will become apparent upon reading the following detailed description and upon referring to the drawings in which.

Figure 1:
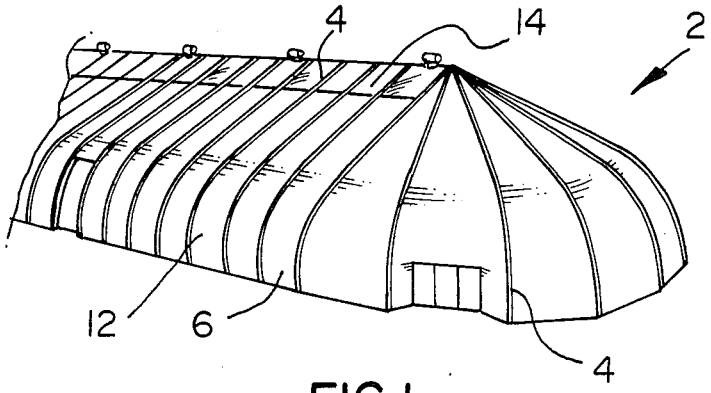
FIG. 1 is a perspective view from the exterior of a pre-stressed fabric structure in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

In the drawings similar features have been given similar reference numerals.

Figure 3:
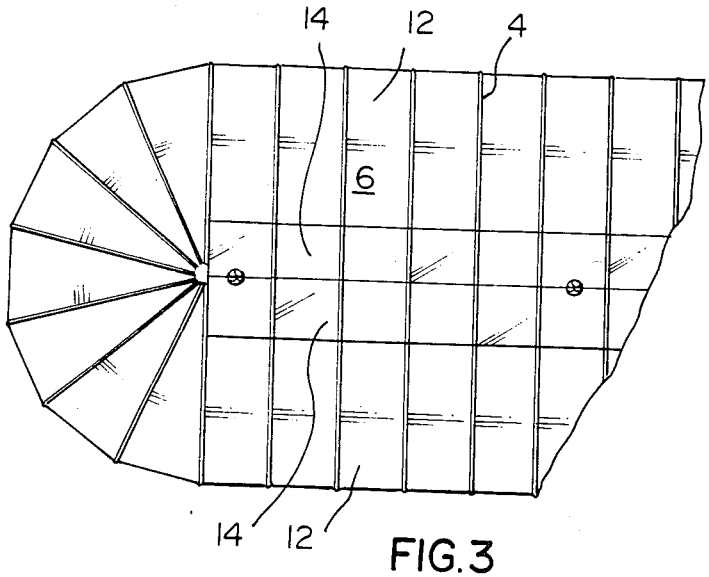
FIG. 3 is a partial plan view of the structure of FIG. 1.
Figure 4:
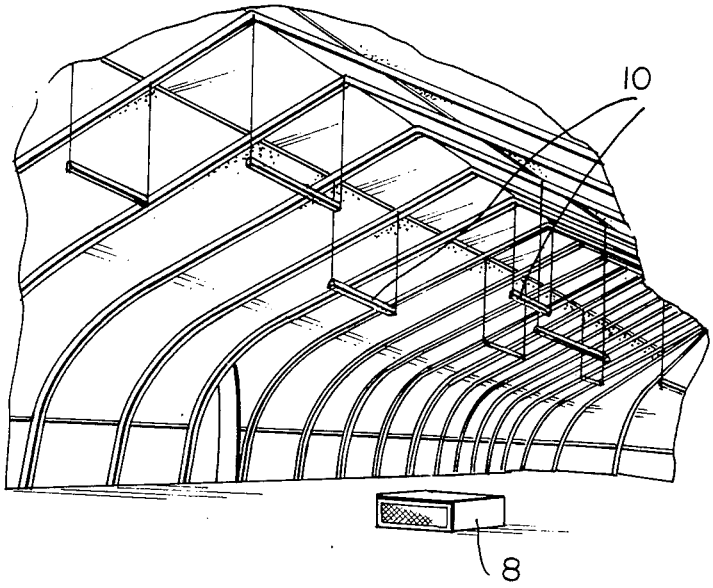
FIG. 4 is a partial interior perspective view of the structure of FIG. 1.

Referring to the drawings, in FIG. 1 there is illustrated an enclosed, pre-stressed fabric structure 2, of the type in question, having a plurality of arches 4 between which is stretched fabric sections 6 under tension, the fabric being secured along its outer edges to adjacent arches. Inside structure 2 is located an appropriate air conditioning means 8 (FIG. 4) and, as required, illumination means 10 for nighttime illumination. Each of the fabric strips 6 extending between parallel arches 4 is composed of zones 12 of exteriorly reflective opaque material and zones 14 of translucent material. In the illustrated embodiment, the zone 14 of translucent material extends in similar fashion along the top of structure 2 in a manner resembling an elongated skylight. This can be readily seen in FIGS. 1, 3 and 4. The opaque fabric may be, for example, polyvinyl chloride-coated polyester such as SHELTER-RITE (trade mark of Siemen Corporation) which has a black out layer inserted between the coating and the scrim, this material being 100% opaque, allowing no light to pass through it. The translucent material may be, for example, a coated polyester open structure fabric such as SHELTER-RITE (trade mark of Siemen Corporation). The two (different) fabrics may be bonded together in any appropriate fashion where they meet in fabric strips 6, to form a single fabric strip.

Figure 2:
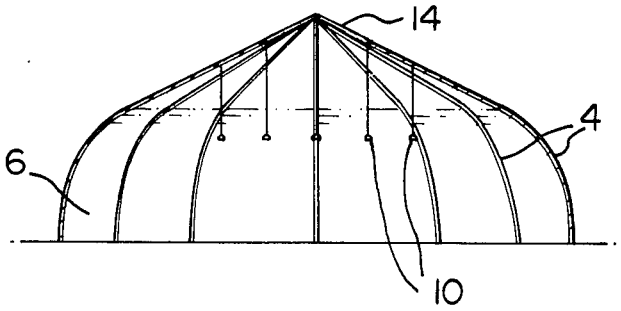
FIG. 2 is a section view along line II—II of FIG. 1.

As can be seen in FIG. 2, the arches 4 along the length of the building have vertical sides 16 which curve into a slanted roof section 18, the rise of which is 26°, the arches meeting at peak 20. While this is a preferred shape of arch, obviously the arch shape may take many different configurations within the scope of the present invention.

The structure in accordance with the present invention requires the respective areas of the opaque and translucent materials to be determined such that the area of translucent material is sufficient to permit adequate light to pass through to the enclosed space during daylight to permit adequate interior lighting of the enclosed space while the area of opaque material is such as to reduce solar radiation into the enclosed space sufficiently to permit the air conditioning means to comfortably cool the interior. In a preferred embodiment, the ratio of the surface area of the translucent material to that of the opaque material is in the range of 1:5, and preferably 1:6.6.

TEST RESULTS

The significant improvement in climate control provided by a structure according to the present invention can be seen from the following results of an air condition test, as set out in the Table. "A" was a structure made from completely opaque fabric, "B" was a structure made in accordance with the present invention, and "C" was a structure made entirely of regular translucent fabric. All structures were in the same locality in the South-Western United States re: the same size and cooled by air conditioning units of similar power. It will be seen from this Table that the structure "B" while permitting light to enter through the translucent panels, also permitted air conditioning which was almost as effective as that in the completely opaque "A" structure.

TABLE

| | Structure | | |
|---|---|---|---|
| Time | "A" Opaque Fabric | "B" Opaque Fabric with translucent panel in accordance with the invention | "C" Regular Translucent |
| | Degrees Farenheight | | |
| 11.30 | 63.8 | 65 | 70.4 |
| 12:30 | 68.2 | 69.5 | 76.1 |
| 1:00 | 67.8 | 70.0 | 76.6 |
| 1:30 | 68.0 | 69.1 | 76.7 |
| 2:10 | 67.8 | 68.4 | 76.7 |
| 2:30 | 67.9 | 68.4 | 78.4 |

NOTE:
86.1 was the temperature outside in shade.

Thus it is apparent that there has been provided in accordance with the invention a light and climate control system for pre-stressed fabric structures that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In an enclosed, pre-stressed fabric structure having a plurality of arches, fabric under tension extending between adjacent arches to enclose a predetermined space and an air conditioner means to cool the enclosed space, the improvement wherein the fabric between the arches is composed of zones of exteriorly reflective opaque material and translucent material, the sizes of the respective areas of the zones of these two materials being determined such that the area of the zone of translucent material is sufficient to permit light to pass to the enclosed space during daylight, for adequate interior lighting of the enclosed space, but the area of the zone reflective opaque material is sufficient to reduce solar radiation into the enclosed space to a degree which permits the air conditioner means to comfortably cool the interior.

2. A structure according to claim 1 wherein the opaque material is made of polyvinyl chloride-laminated or coated polyester.

3. A structure according to claim 1 wherein each of the arches along the length of the structure have vertical sides which curve into slanted roof sections having a rise of 26°, meeting in a peak.

4. A structure according to claim 1 further provided with artificial light means for lighting of the interior of the structure after daylight hours.

5. A structure according to claim 1 wherein the zone of translucent material extends between the tops of the arches and the zone of opaque material extends between the arches on either side of the translucent material.

6. A structure according to claim 5 wherein the ratio of the surface area of the translucent material to that of the opaque material is in the range of 1:5 to 1:6.6.

7. A structure according to claim 6 wherein the ratio of the surface area of the translucent material to that of the opaque material is 1:6.6.

8. In combination a plurality of parallel arches;

a plurality of fabric sections, each said section being secured to and between a respective pair of adjacent arches under tension to define an enclosed space, each said section including at least one zone of translucent material and at least one zone of exteriorly reflective opaque material, said zones being sized with the areas of said zones of translucent material being sufficient to provide adequate interior lighting of said enclosed space and the areas of said zones of opaque material being sufficient to reduce solar radiation into said enclosed space; and an air conditioner means in said enclosed space for cooling said space.

9. The combination as set forth in claim 8 wherein the ratio of surface areas of translucent material to opaque material in each tension fabric section is in a range of from 1:5 to 1:6.6.

* * * * *